US011313169B2

(12) United States Patent
Meyer et al.

(10) Patent No.: US 11,313,169 B2
(45) Date of Patent: Apr. 26, 2022

(54) SAFE ASSEMBLY

(71) Applicant: Steelhead Outdoors LLC, Prior Lake, MN (US)

(72) Inventors: Corey Daniel Meyer, Shakopee, MN (US); Charles Gordon Pehrson, Prior Lake, MN (US)

( * ) Notice: Subject to any disclaimer, the term of this patent is extended or adjusted under 35 U.S.C. 154(b) by 408 days.

(21) Appl. No.: 16/682,363

(22) Filed: Nov. 13, 2019

(65) Prior Publication Data

US 2021/0140222 A1 May 13, 2021

(51) Int. Cl.
*E05G 1/024* (2006.01)
*E05G 1/026* (2006.01)

(52) U.S. Cl.
CPC ..... *E05G 1/024* (2013.01); *E05G 1/026* (2013.01)

(58) Field of Classification Search
CPC ..... E05G 1/00; E05G 1/024; E05G 1/026; E05Y 2800/254; E05Y 2800/414; E05Y 2800/416
USPC ..... 109/78–85, 64, 65, 49.5, 58, 59 R, 59 T, 109/76
See application file for complete search history.

(56) References Cited

U.S. PATENT DOCUMENTS 3,692,015 A * 9/1972 Chase ..... F24C 15/04 52/204.593
4,174,711 A 11/1979 Laing
4,240,397 A * 12/1980 Seidel ..... F24C 3/128 126/285 B
4,272,137 A 6/1981 Rothhaas
4,426,935 A * 1/1984 Nikoden, Jr. ..... A47B 47/03 312/265.5
4,741,276 A * 5/1988 Pollock ..... E05G 1/024 109/82
6,415,557 B1 * 7/2002 McCalley ..... E04H 9/14 52/584.1
6,438,906 B1 * 8/2002 Komarowski ..... E04H 9/14 89/36.01
8,327,778 B2 12/2012 DelloRusso, Jr.
8,474,386 B2 7/2013 DelloRusso, Jr.
2005/0284344 A1 * 12/2005 Alizade ..... E05B 65/0075 109/49.5
2006/0180059 A1 * 8/2006 Martin ..... E04H 1/1238 109/79

(Continued)

FOREIGN PATENT DOCUMENTS

CN 103758434 * 4/2014
CN 205444544 * 8/2016
EP 2072741 12/2007

*Primary Examiner* — Lloyd A Gall

(57) ABSTRACT

A safe assembly includes a housing having a top wall, a bottom wall, a first side wall, a second side wall, a rear wall and a door. The door having a locking mechanism to releasably lock the door in a closed position. Each of the walls includes an outer panel of steel material defining an exterior of the housing. An inner panel of steel material is spaced from the outer panel and has an exterior face facing the outer panel. The exterior face comprises a highly reflective surface. An insulating material is positioned between and fills a space between the outer and inner panels. A plurality of mating flanges is attached to the walls such that each of the walls includes a mating flange securable to a mating flange on one more adjacently positioned one of the walls to form the completed housing.

6 Claims, 8 Drawing Sheets

(56) References Cited

U.S. PATENT DOCUMENTS

| | | | | |
|---|---|---|---|---|
| 2012/0192769 | A1* | 8/2012 | Chiang | E05G 1/024 109/64 |
| 2016/0084563 | A1* | 3/2016 | Ghiraldi | F28D 20/0034 62/457.2 |
| 2016/0273259 | A1* | 9/2016 | DeBaldo | E05G 1/024 |

* cited by examiner

SAFE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to strongbox device and more particularly pertains to a new strongbox device which can be shipped in modular form and assembled quickly while still affording the heat protections of a unitary structure.

(2) Description of Related Art Including Information Disclosed Under 37 CFR 1.97 and 1.98

The prior art relates to strongbox devices and safes in general. When a person purchases a safe it will typically come either as a completed unit or as a modular device. Completed units, while requiring only installation, can be extremely heavy as well as sized to make their movement around corners and through doors difficult. Modular shipping is therefore utilized to allow assembly on the premises to lesson the amount of movement of the safe. However, modular safes do not have the fire/heat protection of preassembled safes and therefore require the installer to loosely attach insulation to the interior surface of the safe. Such installation is tedious and does not provide the level of protection provided by preassembled safes. Moreover, these prior art installations, as well as safes in general, do not include reflective material within their walls to reflect radiant heat outwardly away from the interior of the safe. The present invention overcomes these obstacles by providing modular safe components having pre-installed elements to prevent heat conduction into the interior of a safe.

BRIEF SUMMARY OF THE INVENTION

An embodiment of the disclosure meets the needs presented above by generally comprising a housing including a plurality of walls removably secured together. The walls include a top wall, a bottom wall, a first side wall, a second side wall, and a rear wall. The housing has a front side and a door is hingedly coupled to the second side wall. A locking mechanism is mounted on the housing and releasably locks the door in a closed position. Each of the walls includes an outer panel defining an exterior of the housing. The outer panel comprises a steel material. An inner panel is spaced from the outer panel and has an exterior face facing the outer panel and an interior face directed opposite of the exterior face. The exterior face comprises a highly reflective surface configured to reflect heat back toward the outer panel. The inner panel comprises a steel material. An insulating material is positioned between and fills a space between the outer and inner panels. A plurality of mating flanges is attached to the walls such that each of the walls includes a mating flange securable to a mating flange on one more adjacently positioned one of the walls to form the completed housing. A plurality of couplers is extended through abutting ones of the mating flanges to secure the walls together.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
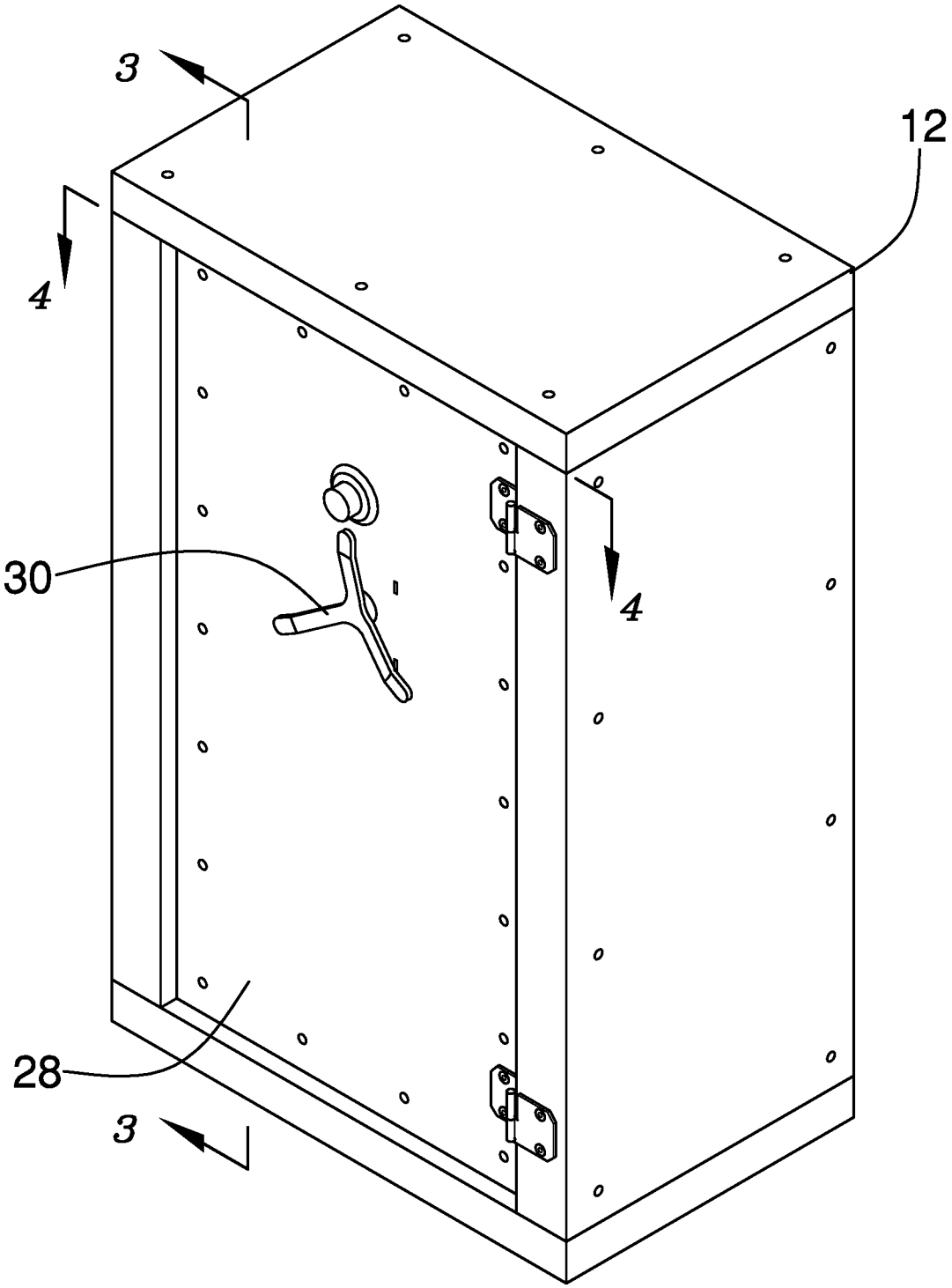
FIG. 1 is a front isometric view of a safe assembly according to an embodiment of the disclosure.
Figure 2:
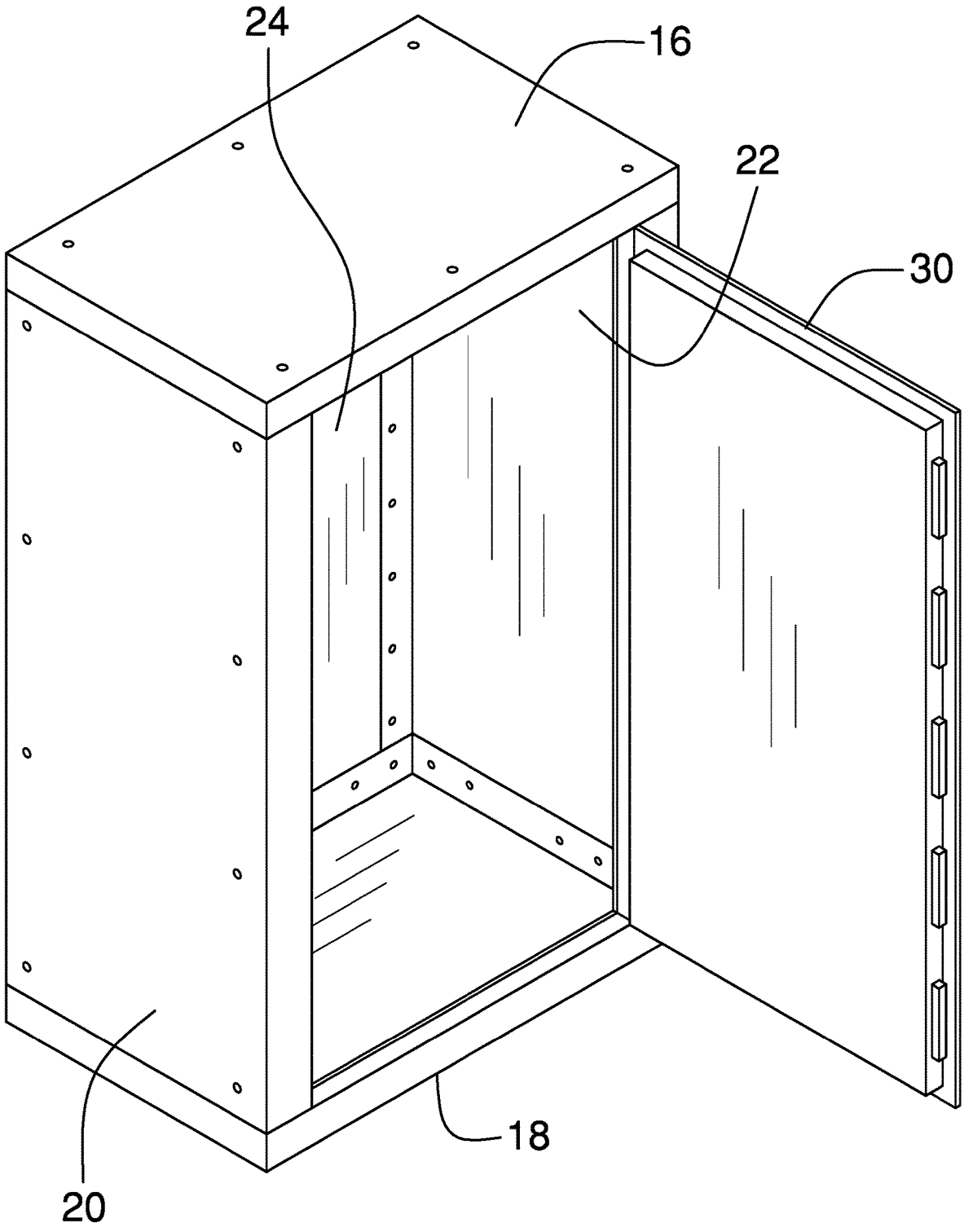
FIG. 2 is a front isometric view of an embodiment of the disclosure.
Figure 3:
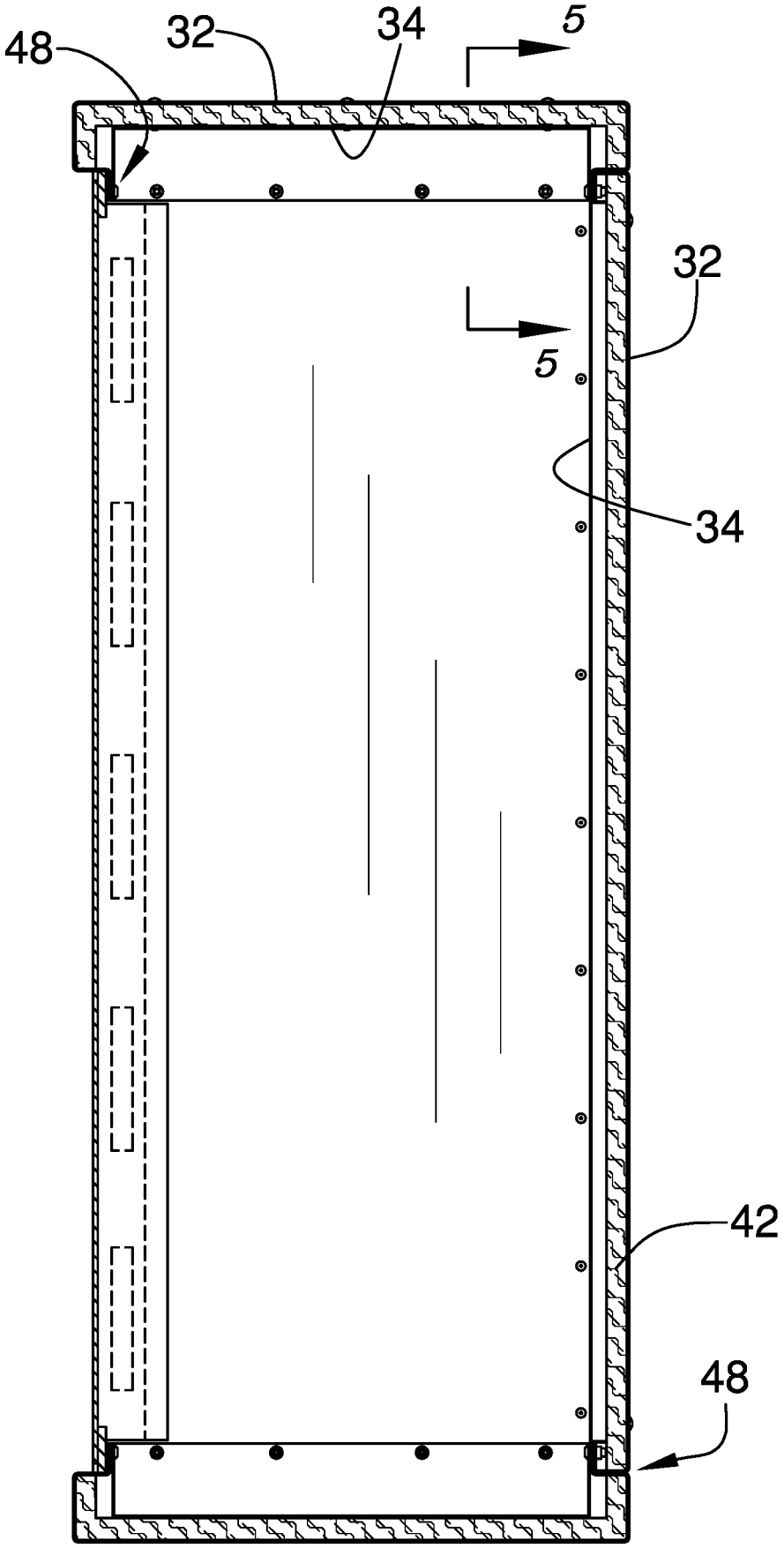
FIG. 3 is a cross-sectional view of an embodiment of the disclosure taken along line 3-3 of FIG. 1
Figure 4:
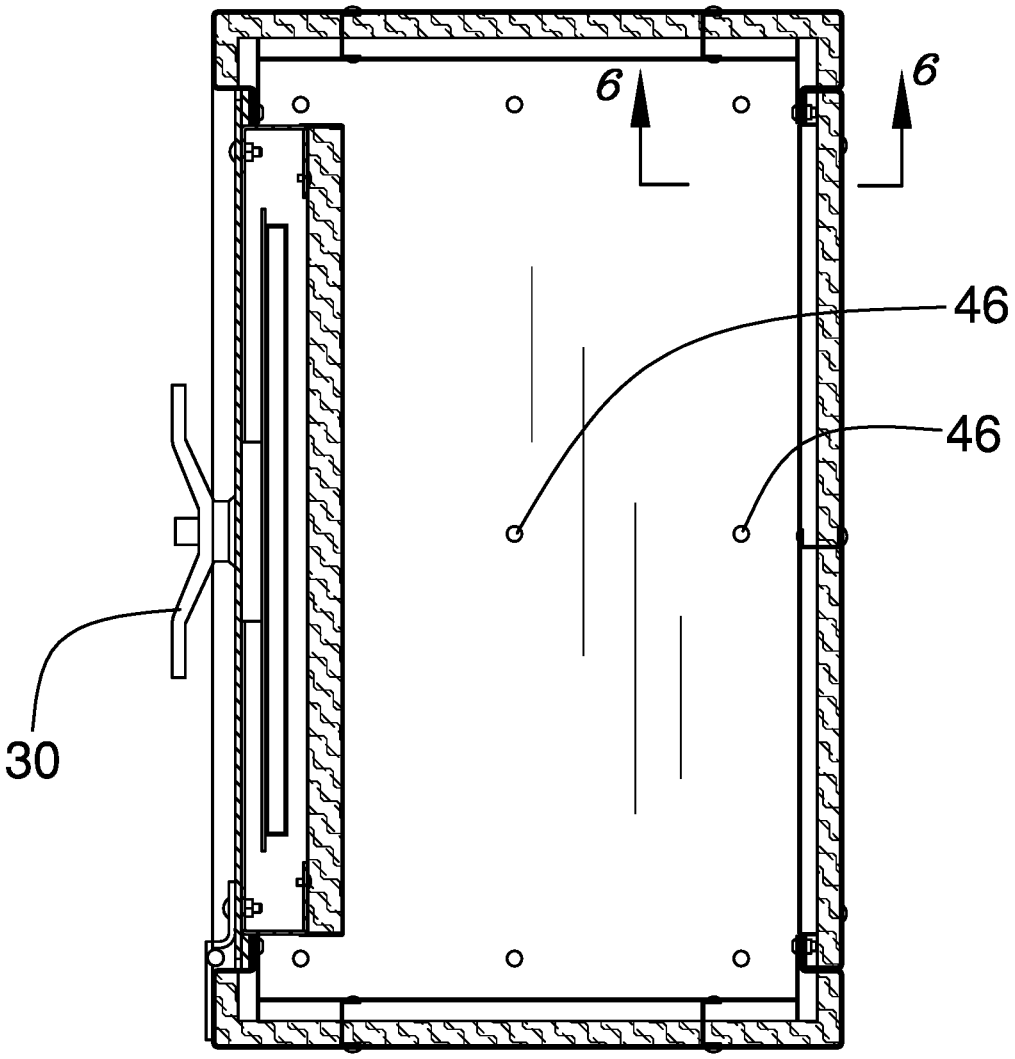
FIG. 4 is a cross-sectional view of an embodiment of the disclosure taken along line 4-4 of FIG. 1.

With reference now to the drawings, and in particular to FIGS. 1 through 8 thereof, a new strongbox device embodying the principles and concepts of an embodiment of the disclosure and generally designated by the reference numeral 10 will be described.

As best illustrated in FIGS. 1 through 8, the safe assembly 10 generally comprises, when fully assembled, a conventional safe which includes a housing 12 having a plurality of walls 14 removably secured together. The walls 14 include a top wall 16, a bottom wall 18, a first side wall 20, a second side wall 22, and a rear wall 24. The housing has a front side 26 that is open. A door 28 is hingedly coupled to the second side wall 22 to close the open front side 26 and is configured to be opened to admit access into an interior of the housing 12. The door 28 is hingedly coupled to the second side wall 22. A locking mechanism 30 is mounted on the housing 12 and releasably locks the door 28 in a closed position. As the locking mechanism 30 is not germane to the present device, the locking mechanism 30 is conventional to safes and may therefore comprise any conventional fully mechanical or mechanical/electronic combination locks. Thus, though not shown, it should be understood that the locking mechanism 30 may include a keypad, fingerprint scanner and other typical lock actuating systems. The locking mechanism may include bolts that extend from the door 28 into the first side wall 20.

Each of the walls 14 includes an outer panel 32 defining an exterior of the housing 12. The outer panel 32 comprises a steel material of sufficient strength and thickness to support each of the walls 14 such that they are not warped by gravity or easily breached when the walls 14 are attached together. An inner panel 34 is spaced from the outer panel 32 and has an exterior face 36 facing the outer panel 32 and an interior face 38 directed opposite of the exterior face 36. The exterior face 36 comprises a highly reflective surface configured to reflect heat back toward the outer panel 32. That is, should the exterior panel 32 be subjected to high heat, the radiant heat emitted from the exterior panel 32 toward the inner panel 34 will be reflected back toward the exterior panel 32 and therefore away from an interior of the housing 12. The inner panel 34 also comprises a steel material wherein the exterior face 36 is polished to promote high reflectivity. However, a paint coating 40 is typically positioned on and covers the interior face 38 of the inner panel 34. The paint coating 40 may be used for aesthetic and insulating characteristics.

Each of the walls 14 and door 28 further includes an insulating material 42 that is positioned between and fills a space between the outer 32 and inner 34 panels. The insulating material 42 will typically comprise a ceramic insulation, often supplied as a fiber insulation blanket-type material. A plurality of brackets 44 is attached to the outer panel 32 and extends toward the inner panel 34. As can be seen in the FIG. 7 for example, the brackets 44 may be elongated and extend across the outer panel 32. This creates insulation spaces where the insulating material 42 may be positioned. The brackets 44 thus help to support the insulation and facilitate installation of the insulation. A plurality of fasteners 46 is provided. Each of the fasteners 46 extends through the inner panel 34 and into one of the brackets 44 to secure the inner panel 34 to the outer panel 32. The fasteners 46 may include any conventional fastener including bolts, screws, rivets and the like. Thus, the insulating material 42 is retained between the inner 34 and outer 32 panels. In this condition, the walls 14 and door 28 are shipped to a customer, for instance, such that the customer need only secure the walls 14 together without having to manipulate the insulating material 42. Once the walls 14 are attached to each other, the housing 12 is completed by attaching the door 28 to the second side wall 22.

A plurality of mating flanges 48 is attached to the walls 14 such that each of the walls 14 includes a mating flange 48 securable to a mating flange 48 on one more adjacently positioned one of the walls to form a completed housing 12. A plurality of couplers 49 is provided wherein each coupler 49 is extended through abutting ones of the mating flanges 48 to secure the walls together. The couplers 49 may include all conventional mechanical couplers such as bolts, screws and the like. Each of the mating flanges 48 includes a first mating member 50 and a second mating member 52. Each of the top 16 and bottom 18 walls has one of the first mating members 52 integrally attached thereto and each of the rear 24, first side 20 and second side 22 walls include the second mating members 52. The first 50 and second 52 mating members are joined together to form the completed housing 12.

Figure 5:
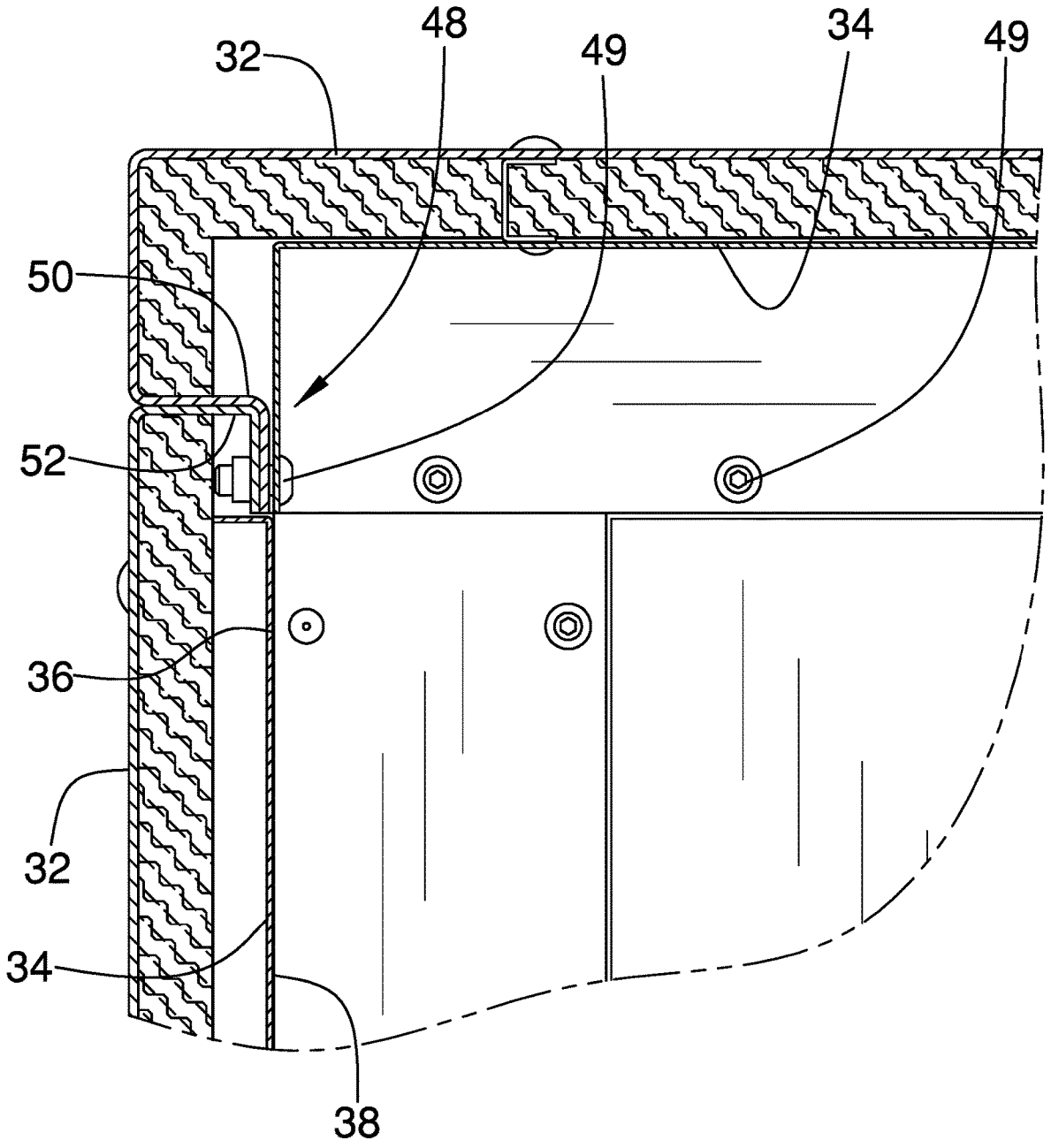
FIG. 5 is a cross-sectional view of an embodiment of the disclosure taken along line 5-5 of FIG. 3
Figure 6:
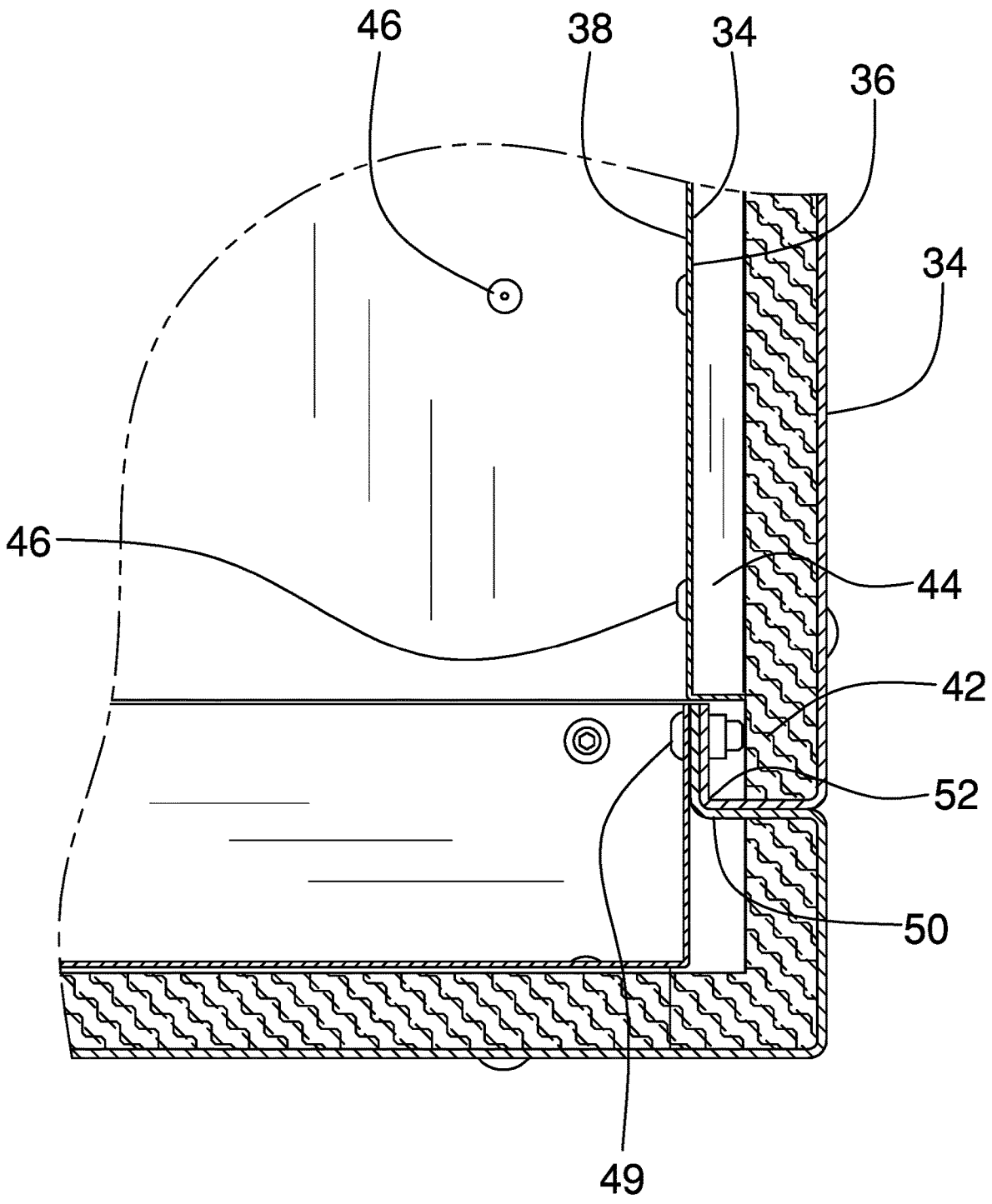
FIG. 6 is a cross-sectional view of an embodiment of the disclosure taken along line 6-6 of FIG. 3.
Figure 7:
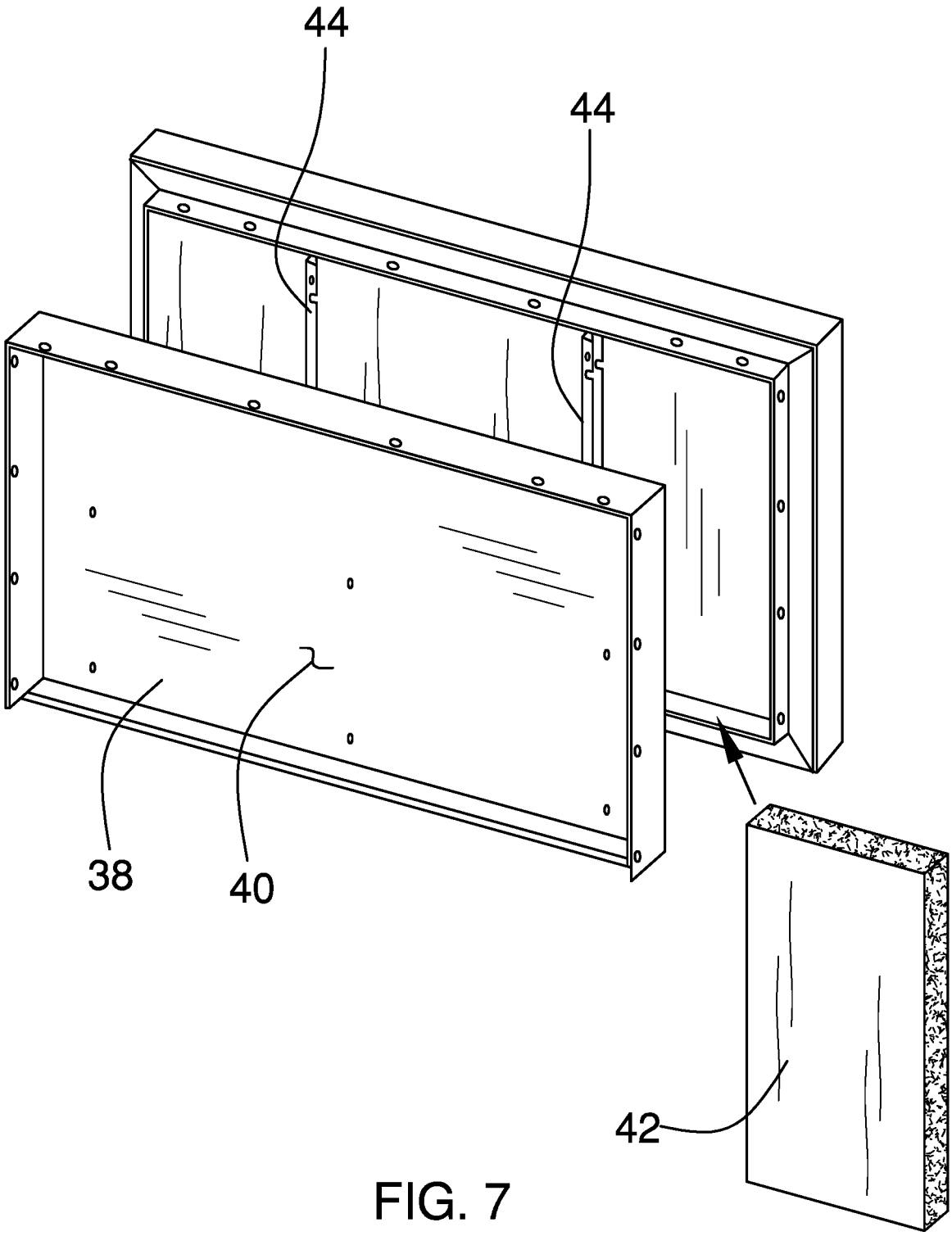
FIG. 7 is an exploded isometric view of an embodiment of the disclosure.

More particularly, the first mating member 50 of the top wall 16 extends downwardly from the outer panel 32 of the top wall 16 and forms a perimeter wall. The first mating member 50 of the bottom wall 18 extends upwardly from the outer panel 32 of the bottom wall 18 and forms a perimeter wall. Each of the rear 24, first side 20 and the second side 22 walls includes a pair of the second mating members 52 attached to a corresponding one of the outer panels 32 and extending inwardly toward a corresponding one of the inner panels 34. The second mating members 52 are positioned such that one of the second mating members 52 engages the first mating member 50 on the top wall 16 and one of the second mating members 52 engages the first mating member 50 on the bottom wall 18. Thus, each of the rear 24, first side 20 and second side 22 walls will typically include a second mating member 52 adjacent to their respective upper edges and a second mating member adjacent 52 to their respective lower edges. As can be seen in FIGS. 5 and 6, the first mating members 50 form a shoulder which receives the second mating members 52. This allows the front 26, rear 24, first side 20 and second 22 side walls to be positioned on the bottom wall 18, secured in place, and then the top wall 16 is then placed on top and secured. The first 50 and second 52 mating members therefore serve the dual purpose of creating a seal between the walls but also to more easily assemble the housing.

Figure 8:
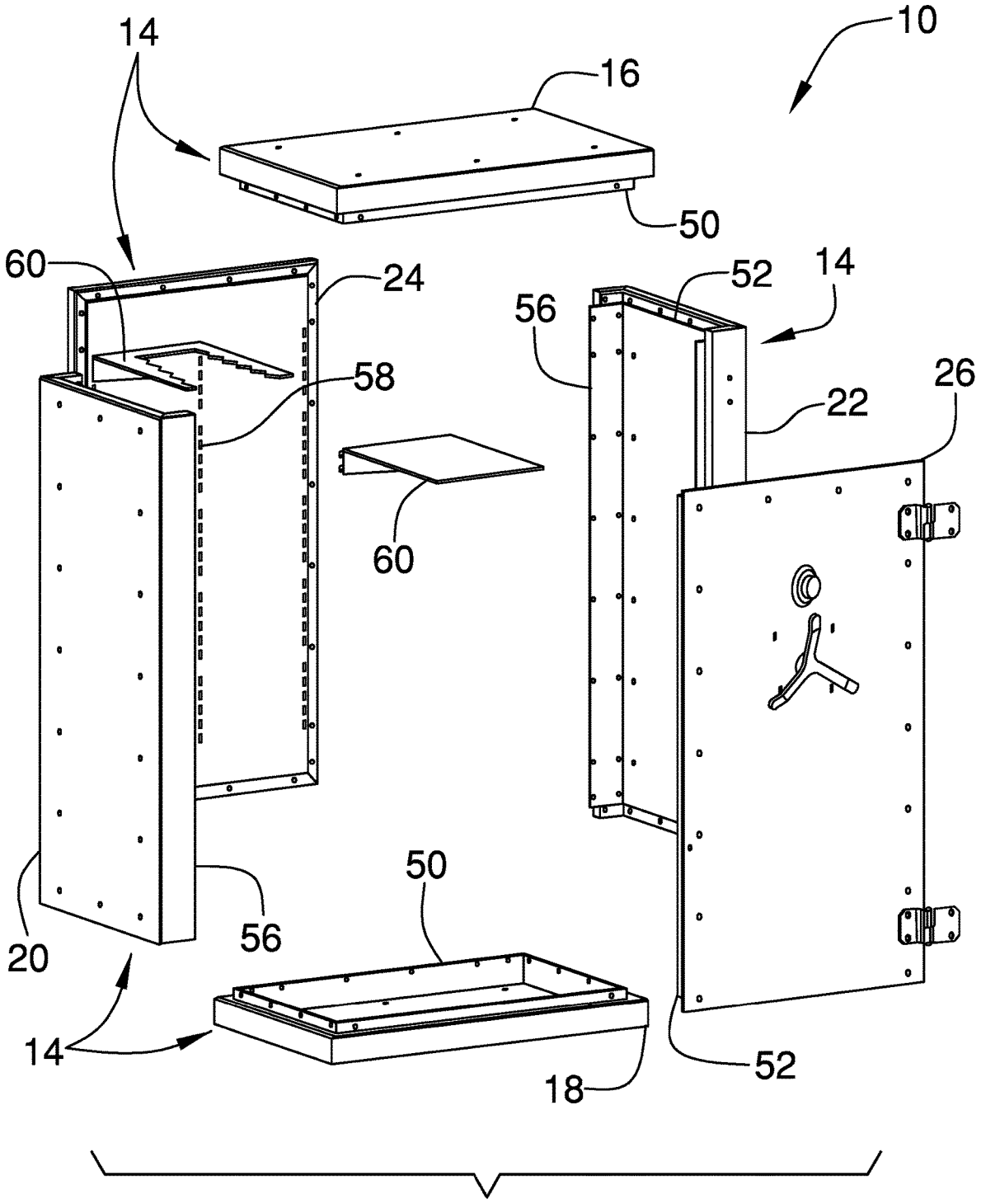
FIG. 8 is an exploded isometric view of an embodiment of the disclosure.

As can be seen in FIG. 8, lateral flanges 56 on the first 20 and second 22 side walls may overlap with the front 26 and rear 24 walls. These are secured to the rear 24 wall to further enhance the stability of the housing 12 while creating a better seal between the walls 14.

Shelving mounts 58 may be positioned on the walls 14 as can shown in FIG. 8. These are attached to or embedded into the inner panel 34. Shelving 60 can then be secured in place on the walls 14 with the shelving mounts 58.

In use, typically an unassembled structure is sent to a customer as it is much easier to move the sections of a safe into a dwelling than is a completed safe. In this particular embodiment, the customer receives walls 14 that are already built and simply need to be attached together. The customer receives the walls 14 and assembles them as indicated above. Once completed, the housing 12 will function as a conventional safe with heat reflective properties to keep valuables positioned inside protected from a fire.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A modular safe assembly configured to have heat insulating properties to protect valuables within the modular safe assembly from a fire, said assembly comprising:

a housing including a plurality of walls removably secured together, said walls including a top wall, a bottom wall, a first side wall, a second side wall, and a rear wall, said housing having a front side, a door being hingedly coupled to said second side wall, said door being configured to be opened to admit access into an interior of said housing;

a locking mechanism being mounted on said housing and releasably locking said door in a closed position;

each of said walls and said door including:

an outer panel defining an exterior of said housing, said outer panel comprising a steel material;

an inner panel being spaced from said outer panel, said inner panel having an exterior face facing said outer panel and an interior face directed oppositely of said exterior face, said exterior face comprising a highly reflective surface configured to reflect heat back toward said outer panel, said inner panel comprising a steel material;

an insulating material being positioned between and filling a space between said outer and inner panels;

a plurality of mating flanges being attached to said walls such that each of said walls includes a mating flange securable to a mating flange on one more adjacently positioned one of said walls to form a completed housing; and a plurality of couplers, said couplers being extended through abutting ones of said mating flanges to secure said walls together.

2. The modular safe assembly according to claim 1, wherein each of said walls further includes a paint coating being positioned on and covering said interior face.

3. The modular safe assembly according to claim 1, wherein each of said walls further includes said insulating material comprising a ceramic insulation.

4. The modular safe assembly according to claim 1, wherein each of said walls further includes:

a plurality of brackets being attached to said outer panel and extending toward said inner panel;

a plurality of fasteners, each of said fasteners extending through said inner panel and into one of said brackets to secure said inner panel to said outer panel.

5. The modular safe assembly according to claim 1, wherein each of said mating flange includes a first mating member and a second mating member, each of said top and bottom walls having one of said first mating members integrally attached thereto and each of said rear, first side and second side walls include said second mating members, wherein said first and second mating members are joined together to form a completed housing, said first mating member of said top wall extending downwardly from said outer panel of said top wall and forming a perimeter wall, said first mating member of said bottom wall extending upwardly from said outer panel of said bottom wall and forming a perimeter wall, each of said rear, first side and said second side walls each including a pair of said second mating members attached to a corresponding one of said outer panels and extending inwardly toward a corresponding one of said inner panels, said second mating members being positioned such that one of said second mating members engages said first mating member on said top wall and one of said second mating members engages said first mating member on said bottom wall.

6. A modular safe assembly configured to have heat insulating properties to protect valuables within the modular safe assembly from a fire, said assembly comprising:

a housing including a plurality of walls removably secured together, said walls including a top wall, a bottom wall, a first side wall, a second side wall, and a rear wall, said housing having a front side, a door being hingedly coupled to said second side wall and being configured to be opened to admit access into an interior of said housing;

a locking mechanism being mounted on said housing and releasably locking said door in a closed position;

each of said walls and said door including:

an outer panel defining an exterior of said housing, said outer panel comprising a steel material;

an inner panel being spaced from said outer panel, said inner panel having an exterior face facing said outer panel and an interior face directed oppositely of said exterior face, said exterior face comprising a highly reflective surface configured to reflect heat back toward said outer panel, said inner panel comprising a steel material;

a paint coating being positioned on and covering said interior face;

an insulating material being positioned between and filling a space between said outer and inner panels, said insulating material comprising a ceramic insulation;

a plurality of brackets being attached to said outer panel and extending toward said inner panel;

a plurality of fasteners, each of said fasteners extending through said inner panel and into one of said brackets to secure said inner panel to said outer panel;

a plurality of mating flanges being attached to said walls such that each of said walls includes a mating flange securable to a mating flange on one more adjacently positioned one of said walls to form a completed housing;

a plurality of couplers, said couplers being extended through abutting ones of said mating flanges to secure said walls together;

each of said mating flanges including a first mating member and a second mating member, each of said top and bottom walls having one of said first mating members integrally attached thereto and each of said rear, first side and second side walls include said second mating members, wherein said first and second mating members are joined together to form a completed housing, said first mating member of said top wall extending downwardly from said outer panel of said top wall and forming a perimeter wall, said first mating member of said bottom wall extending upwardly from said outer panel of said bottom wall and forming a perimeter wall, each of said rear, first side and said second side walls each including a pair of said second mating members attached to a corresponding one of said outer panels and extending inwardly toward a corresponding one of said inner panels, said second mating members being positioned such that one of said second mating members engages said first mating member on said top wall and one of said second mating members engages said first mating member on said bottom wall.

* * * * *